US006249224B1

(12) United States Patent
Shoen et al.

(10) Patent No.: US 6,249,224 B1
(45) **Date of Patent: *Jun. 19, 2001**

(54) LATCH INTEGRATED, TAMPER RESISTANT, ELECTRO-MAGNETIC ALARM SWITCH

(75) Inventors: Edward J. Shoen, Phoenix, AZ (US); William A. Hayden, Hammond, IN (US)

(73) Assignee: U-Haul International, Inc., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/669,107

(22) Filed: Sep. 25, 2000

Related U.S. Application Data

(63) Continuation of application No. 09/200,540, filed on Nov. 25, 1998, now Pat. No. 6,124,792.

(51) Int. Cl.[7] ..... G08B 13/08

(52) U.S. Cl. ..... 340/545.2; 340/545.1; 340/547; 340/693.6; 340/686.3; 200/61.93

(58) Field of Search ..... 340/545.2, 545.1, 340/547, 693.6, 686.3; 200/61.67, 61.68, 61.93; 70/108; 292/140, 333

(56) References Cited

U.S. PATENT DOCUMENTS

| | | | | |
|---|---|---|---|---|
| 912,454 | | 2/1909 | Fesenbeck | 200/61.67 |
| 1,044,099 | | 11/1912 | Spring | 200/61.67 |
| 2,436,470 | | 2/1948 | Fleming | 340/527 |
| 2,588,080 | | 3/1952 | Boodakian | 200/61.68 |
| 2,818,475 | | 12/1957 | Harry | 200/61.64 |
| 2,924,682 | | 2/1960 | Winterburn | 335/274 |
| 3,196,293 | | 7/1965 | Howard | 307/114 |
| 3,284,593 | | 11/1966 | Hawkins | 200/61.64 |
| 3,410,245 | | 11/1968 | Kashden et al. | 116/67 R |
| 3,569,645 | | 3/1971 | Lea | 200/61.62 |
| 3,704,460 | | 11/1972 | Frank | 340/542 |
| 3,793,565 | | 2/1974 | Smith | 361/172 |
| 3,932,718 | | 1/1976 | Porat | 200/61.93 |
| 4,100,419 | | 7/1978 | Pedroso | 378/160 |
| 4,196,422 | | 4/1980 | Swigert et al. | 340/542 |
| 4,211,990 | | 7/1980 | Gwozdz | 335/205 |
| 4,232,309 | | 11/1980 | Dillitzer | 340/547 |
| 4,283,718 | | 8/1981 | Butler et al. | 340/545 |
| 4,536,754 | | 8/1985 | Holce et al. | 340/586.2 |
| 4,671,549 | * | 6/1987 | Marotto et al. | 292/333 |
| 4,845,471 | | 7/1989 | Chu | 340/542 |
| 4,866,426 | | 9/1989 | Evans et al. | 340/541 |
| 4,903,010 | | 2/1990 | Greene | 340/693.11 |
| 4,990,898 | | 2/1991 | Greene | 340/693.11 |
| 5,484,177 | * | 1/1996 | Fortune et al. | 292/140 |
| 5,493,278 | | 2/1996 | MacKenzie et al. | 340/638 |
| 5,656,982 | | 8/1997 | Kurahara | 335/205 |
| 5,668,533 | | 9/1997 | Jackson et al. | 340/547 |
| 5,673,021 | | 9/1997 | Woods | 340/547 |
| 5,878,606 | * | 3/1999 | Chaput et al. | 70/108 |
| 5,925,861 | * | 7/1999 | Fromberg | 200/61.67 |
| 6,124,792 | * | 9/2000 | Shoen et al. | 340/545.2 |

* cited by examiner

*Primary Examiner*—Benjamin C. Lee
(74) *Attorney, Agent, or Firm*—Rod S. Berman, Esq.; Jeffer, Mangels, Butler & Marmaro LLP

(57) ABSTRACT

An alarm switch assembly includes a housing having first and second surfaces and an opening defined therein that extends from one surface toward the other surface. The opening is further defined by at least four inner surfaces. A magnetic field generating device is disposed adjacent the opening and between the first and second surfaces, and a switch is disposed adjacent the opening and is opposed to the magnetic field generating device.

12 Claims, 5 Drawing Sheets

FIG. 1
PRIOR ART
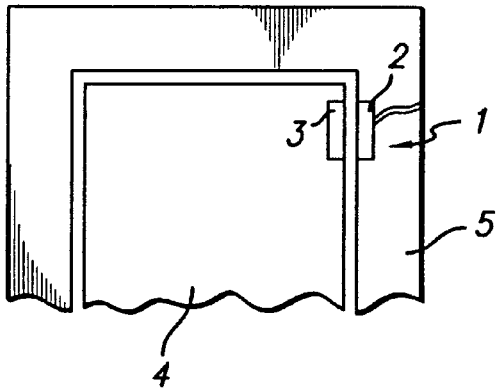
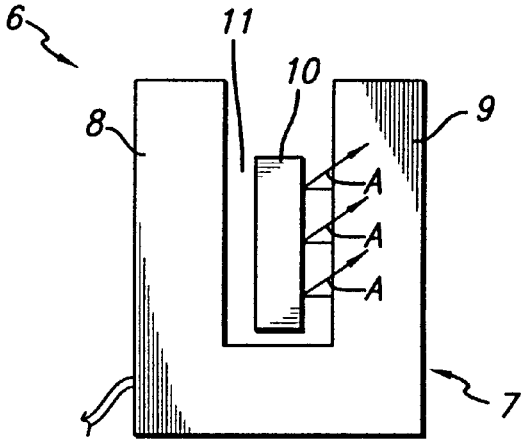
FIG. 2
PRIOR ART
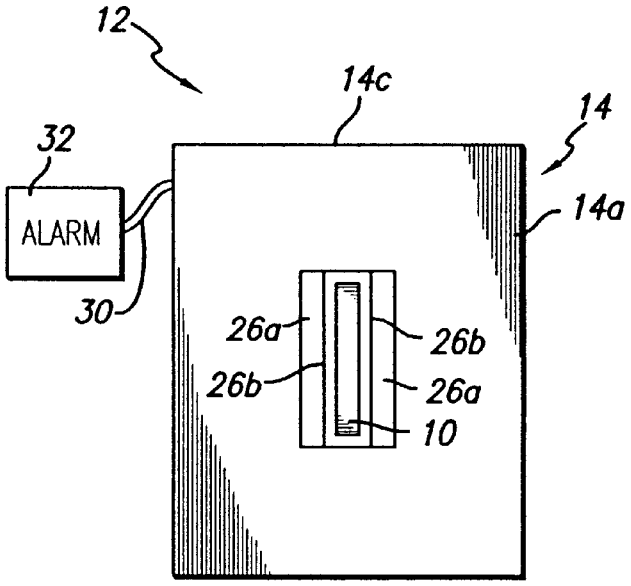
FIG. 6

LATCH INTEGRATED, TAMPER RESISTANT, ELECTRO-MAGNETIC ALARM SWITCH

This is a continuation of application Ser. No. 09/200,540, filed on Nov. 25, 1998, now U.S. Pat. No. 6,124,792.

FIELD OF THE INVENTION

The present invention relates to alarm switches used with security systems, and more particularly to an electromagnetic alarm switch that is substantially tamper-resistant.

BACKGROUND OF THE INVENTION

FIG. 1 shows a prior art electromagnetic alarm switch assembly 1. The assembly generally includes a magnetic switch 2 and a magnet 3 that are separate components and are mounted in close proximity to each other on a closed door 4 and door frame 5 (or window and window frame). In operation, as the door 4 is opened and the switch 2 and magnet 3 move apart, at a predetermined distance the effect of the magnetic field of the magnet is no longer imposed on the switch, the switch reacts, and the alarm sounds. Typically, the switch 2 is normally "open," meaning that the alarm is on. However, when the door 4 is closed and the magnet 3 is in close proximity, the magnet 3 holds the switch 2 in a closed (alarm off) position. As the door 4 is opened and the magnet 3 moves away from the switch 2, the switch 2 reverts to the normally open position, thus sounding the alarm. These types of switches can be easily circumvented simply by holding a magnet in close proximity to the switch 2 while the door is opened, thereby maintaining the switch 2 in the closed position.

FIG. 2 shows another prior art electro-magnetic alarm switch assembly 6. The assembly 6 includes a housing 7 having a first 8 and second 9 portion. The first portion 8 includes a switch and the second portion 9 includes a magnet. The assembly 6 is designed to function with a slidable door latch 10, such as is often used on a raisable overhead door. The closed door latch 1 0 lies at rest through the open mid-portion 11 of the "U". The switch is normally "closed" (alarm off). When the slidable latch 10 is in the closed door position, as shown, interaction between the magnet and the switch is blocked by the latch 10 (as shown by arrows A). When the slidable latch is withdrawn, as to open the door, the magnet causes the switch to open, thereby sounding the alarm. A drawback to this design is that the assembly 6 can easily be "tampered with" by inserting into open mid-portion 11 a metal "dummy" latch before withdrawing the latch 10, thereby maintaining the block between the magnet and the switch and allowing the door to be opened while preventing activation of the alarm.

Other prior art alarm switches are known, however many of these are not provided for use with a slidable door latch. Examples of prior art alarm switches can be found in U.S. Pat. Nos. 5,673,021 to Woods and 5,668,533 to Jackson et al.

A long felt need exists for an alarm switch assembly that is provided for use with a slidable door latch and is substantially tamper-resistant.

SUMMARY OF THE PREFERRED EMBODIMENTS

In accordance with one embodiment of the present invention there is provided an alarm switch assembly that includes a housing having first and second surfaces and an opening defined therein that extends from one surface toward the other surface. The opening is further defined by at least four inner surfaces. A magnetic field generating device is disposed adjacent the opening and between the first and second surfaces, and a switch is disposed adjacent the opening and is opposed to the magnetic field generating device.

In a preferred embodiment, the opening is rectangular and preferably includes a pair of projections that extend inwardly from opposed inner surfaces that define the opening. In a particular embodiment, the switch is disposed in a switch opening that is at least partially defined in one projection and the magnet is disposed in a magnet opening that is at least partially defined in the other projection.

In another preferred embodiment, the opening includes a convergent section and a divergent section.

In accordance with another aspect of the present invention there is provided a latch system that includes the alarm switch assembly described above and a latch received in the opening. A clearance not exceeding about 0.020" is defined between the latch and at least one of the inner surfaces of the housing.

In accordance with yet another aspect of the present invention there is provided an alarm system that includes the latch system described above and an alarm. The lead wires electrically connect the switch to the alarm.

In accordance with another aspect of the present invention there is provided a door assembly that includes a door, the latch slidably affixed to the door, a door frame having an opening defined therein at least partially surrounding the door, and the alarm system described above affixed to the door frame. The opening in the door frame and the opening in the housing cooperate to define a latch opening; the latch is received in the latch opening; and a clearance not exceeding about 0.020" is defined between the latch and at least one of the inner surfaces of the housing.

In accordance with another aspect of the present invention there is provided a method of activating an alarm. The method includes the steps of providing the door assembly described above and detecting withdrawal of the latch from the latch opening.

In accordance with yet another aspect of the present invention there is provided an alarm switch assembly that includes a housing having first, second and third portions that cooperate to define an opening. The housing also includes at least one blocking portion that extends inwardly from the first or the third portion. A magnetic field generating device is disposed adjacent the opening and between the first and second surfaces, and a switch is disposed adjacent the opening and opposed to the magnetic field generating device.

It will be understood that the device is not limited to activation by a magnetic field generating device. Any field, beam or the like that is blocked by the latch and can be sensed when the latch is removed is within the scope of the present invention. For example, a light beam emitting device and appropriate receptor can be used. A jet of air emitting device and appropriate receptor can be used. Sound waves, such as ultrasonic waves produced by a magnetostrictive element can be used.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which FIG. 1 is a view of a door and a door frame having a prior art 2-piece electro-magnetic alarm switch device affixed thereto.

FIG. 2 is a front elevation of a prior art 1 piece, non-enclosed electro-magnetic alarm switch assembly having a slidable door latch engaged therewith.

FIG. 6 is a front elevation of the switch assembly of FIG. 3 having a slidable door latch inserted therein.

Like numerals refer to like parts throughout the several views of the drawings.

DETAILED DESCRIPTION OF THE PREFERRED EMBODIMENTS

Figure 3:
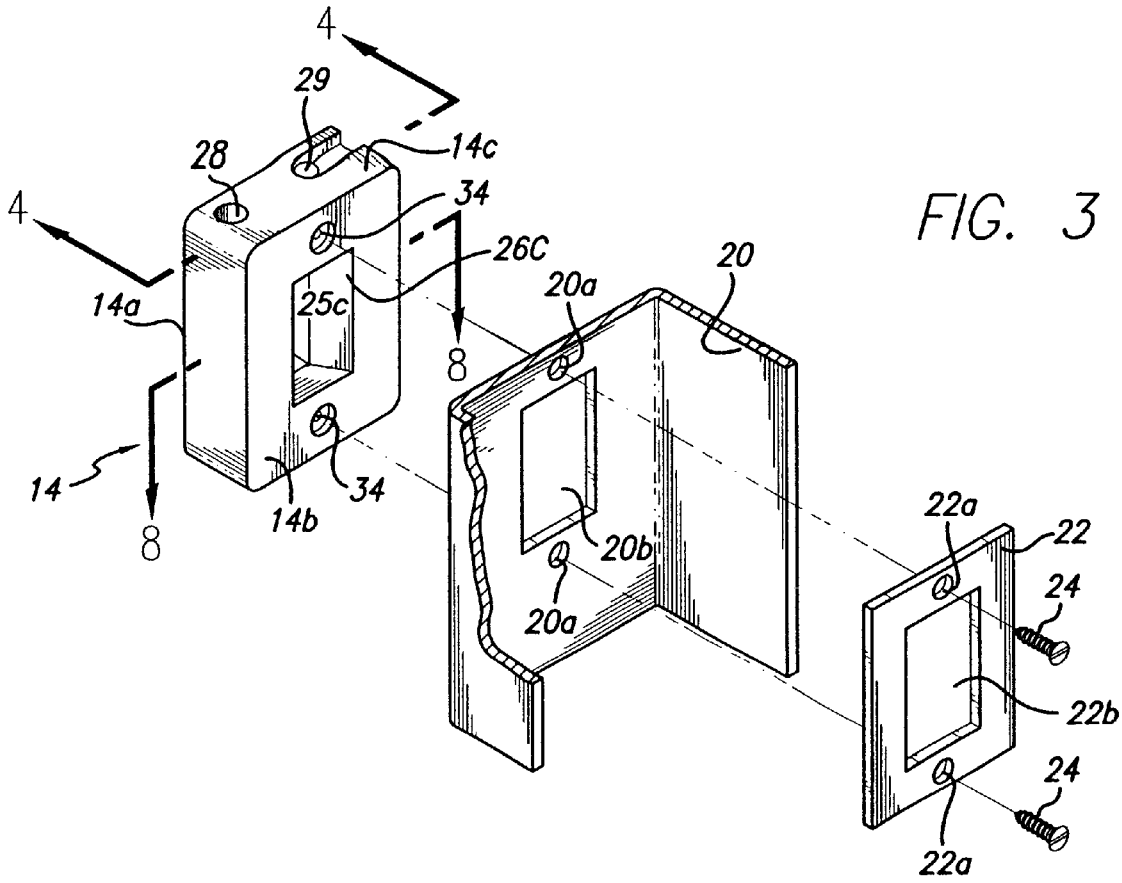
FIG. 3 is an exploded perspective view of a switch assembly in accordance with a first embodiment of the present invention, a door frame and a striker plate.

Referring to FIGS. 3–8, a preferred embodiment of an electro-magnetic alarm switch assembly 12 for use with a slidable door latch 10 is shown. Switch assembly 12 generally includes a housing 14, an alarm switch 16 and a magnet 18.

It will be appreciated that terms such as "front" and "rear" used hereinbelow are merely for ease of description and refer to the orientation of the components as shown in the Figures. It should be understood that any orientation of switch assembly 12 described herein is within the scope of the present invention.

For exemplary purposes only, described hereinbelow is a preferred embodiment wherein switch assembly 12 is provided for use with a slidable door latch 10 (being slidable between an open and a closed position) of an overhead door 19 and is mounted to a door frame 20 using a striker plate 22 and screws 24. It will be understood, however, that the type of door, the door frame, striker plate or hardware for mounting switch assembly 12 are not limitations on the present invention. For example, switch assembly 12 can be used with a hinged door.

Housing 14 is preferably comprised of a plastic such as nylon or a phenolic or other synthetic resin. Housing 14 can be comprised of any non-magnetic material that does not interfere with the magnetic effect exerted on alarm switch 16.

Figure 8:
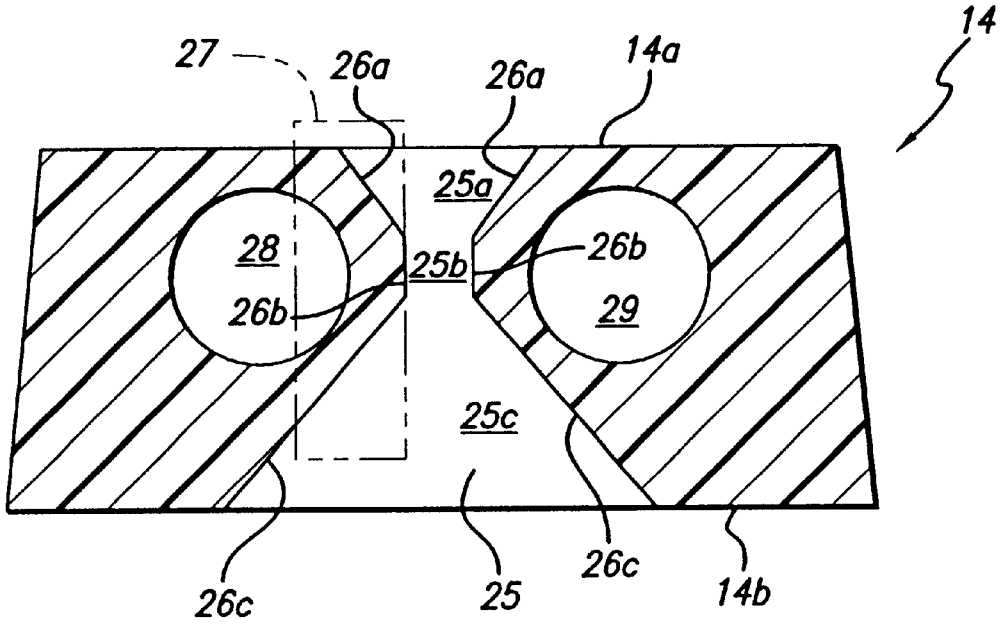
FIG. 8 is a top sectional plan view of the switch assembly of FIG. 3 taken along line 8—8 of FIG. 3. The magnet and switch are omitted.

Housing 14 has a front surface 14*a* and a rear surface 14*b*. A slot 25 is defined through housing 14 from front surface 14*a* to rear surface 14*b*. It will be understood that the term slot is not a limitation on the present invention and that slot 25 can be any opening. As shown in the Figures, slot 25 is substantially rectangular, however it can be circular, ellipsoidal or other shape. In a preferred embodiment, slot 25 is divided into three sections, a front section 25*a*, middle section 25*b* and rear section 25*c*. Middle section 25*b* is defined by inner surfaces 26*b* that are substantially parallel. As illustrated in FIG. 8, front section 25*a* and rear section 25*c* are defined by surfaces 26*a*, 26*c*, respectively, that slope away from middle section 25*b* and toward the front 14*a* and rear surfaces 14*b* of housing 14, respectively. Preferably, from front surface 14*a* to rear surface 14*b*, section 25*a* is convergent, section 25*b* is a throat section and section 25*c* is divergent. It will be understood that sections 25*a, b* and *c* can be defined by surfaces that are planar, concave or convex.

Figure 9:
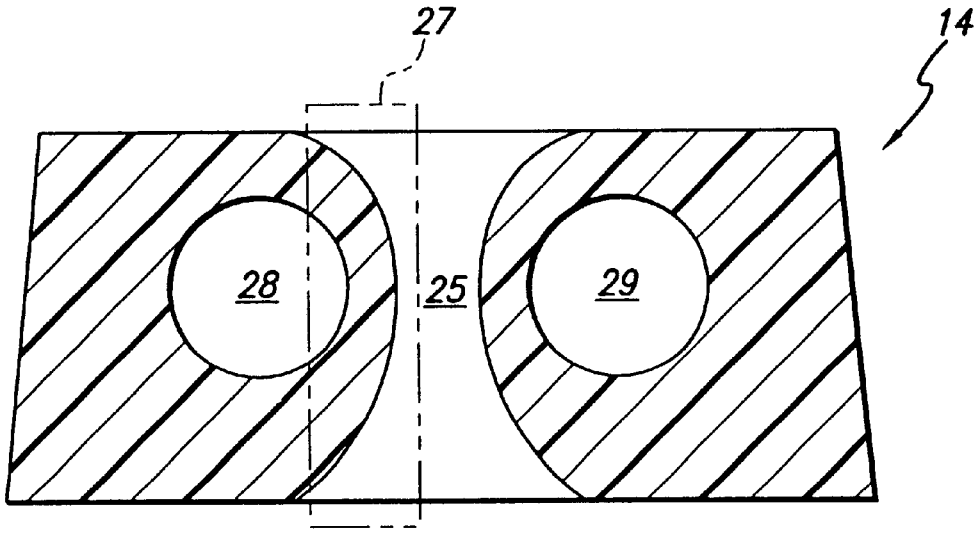
FIG. 9 is a top sectional plan view of the a switch assembly with projections having rounded edges in accordance with an alternative embodiment of the present invention.

Surfaces 26*a*, 26*b* and 26*c* define a pair of projections 27. The projections 27 extend into slot 25. In an alternative embodiment, the projections 27 can also have rounded corners, as shown in FIG. 9.

Figure 4:
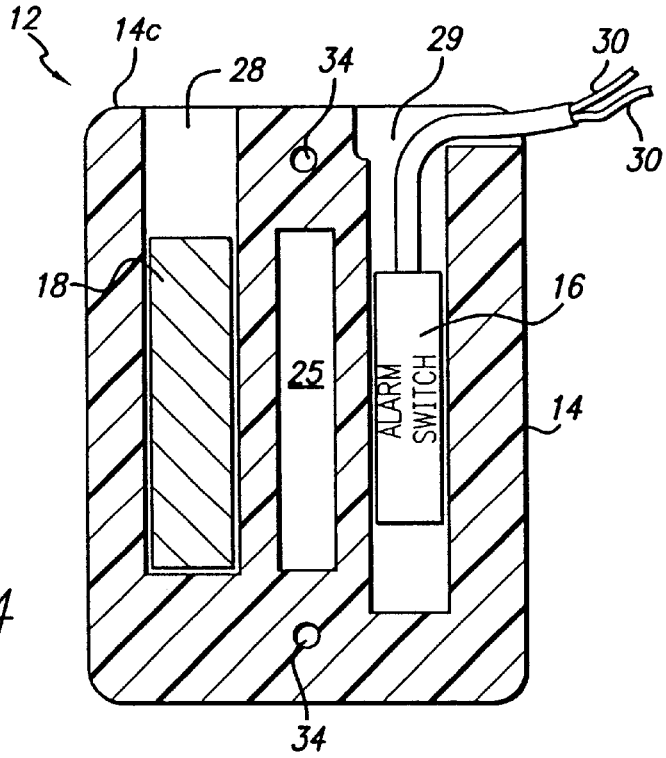
FIG. 4 is a sectional rear elevation of the switch assembly of FIG. 3 taken along line 4—4 of FIG. 3 showing the alarm switch and magnet disposed in the housing.
Figure 5:
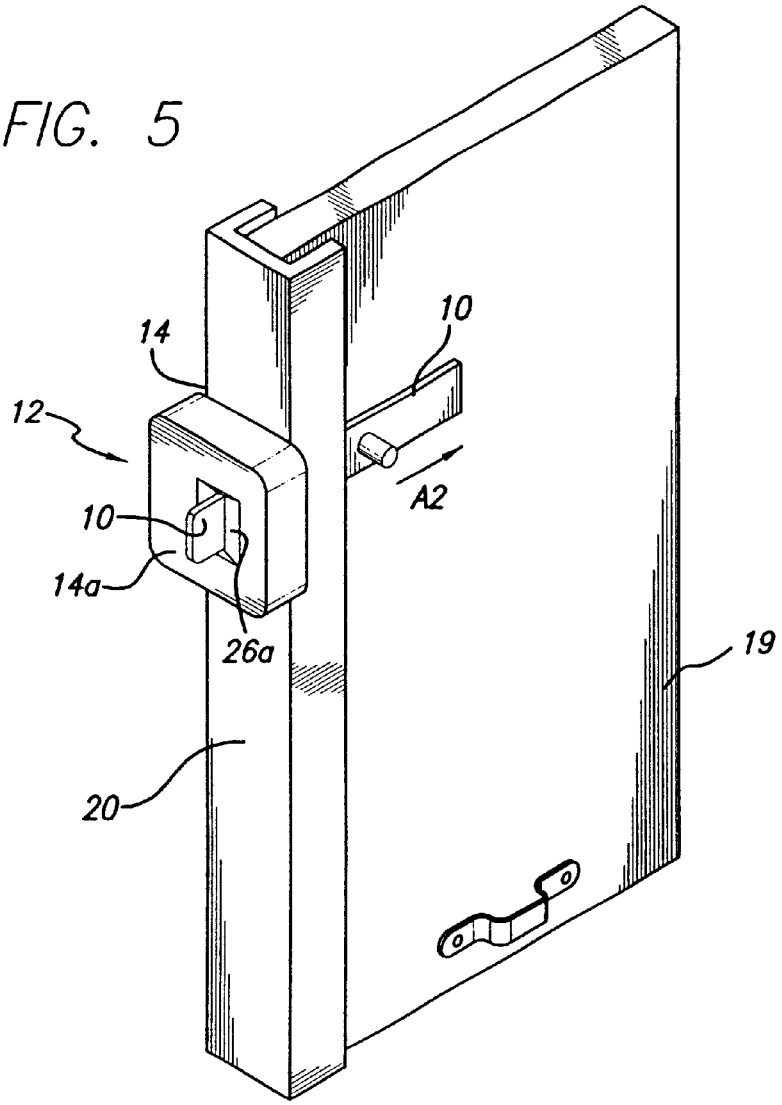
FIG. 5 is a perspective view of an overhead door having a slidable door latch and the switch assembly of FIG. 3 affixed to the door frame.

In a preferred embodiment, housing 14 includes a magnet chamber 28 defined therein. Preferably, magnet chamber 28 extends from the top surface 14*c* of housing 14 and runs substantially parallel to slot 25, as shown in FIG. 4. Housing 14 also has switch chamber 29 defined therein. Preferably, switch chamber 29 extends from the top surface 14*c* of housing 14 and runs substantially parallel to slot 25 and magnet chamber 28. Magnet chamber 28 and switch channel 29 are shown in the Figures as being cylindrical (i.e., having a circular transverse cross-section). However, they can also have a square, rectangular or other shaped transverse cross-section. It will be understood that the term chamber is not a limitation on the present invention and that magnet chamber 28 and switch chamber 29 can be any opening.

Magnet chamber 28 and switch chamber 29 are defined on opposite sides of slot 25, as shown in FIG. 4. In a preferred embodiment, the magnet and switch chambers 28 and 29 are each defined at least partially in one of the projections 27, as illustrated in FIG. 8. Magnet 18 is preferably secured in magnet chamber 28 using glue, resin or similar adhesive. However, magnet 18 can alternatively be disposed in magnet chamber 28 without being secured therein. It will be understood that any magnet field generating device is within the scope of the present invention. Switch chamber 29 has alarm switch 16 secured therein in a similar manner.

Slot 25 is preferably dimensioned such that slidable door latch 10 fits therein with a relatively small amount of clearance on each side. It will be understood that the dimensions of slot 25 will be dependent on the size of the slidable door latch with which the switch assembly will be used. It will be further understood that the clearance between slidable door latch 10 and inner surface 26*b* is such that a "dummy" latch cannot be easily inserted therein. As used herein a "dummy" latch is an object that can be inserted between slidable door latch 10 and inner surface 26*b* such that when latch 10 is withdrawn the object blocks the magnetic field produced by magnet 18 and prevents same from affecting alarm switch 16. Preferably, the clearance between latch 10 and housing 14 is no more than 0.020". Therefore, a "dummy" latch inserted therein must be thinner than 0.020". Such a "dummy" latch is not readily available.

Alarm switch 16 can be any electromagnetic switch known in the art, such as a reed-type switch. It will be appreciated by those skilled in the art that the switch elements of a reed switch change state when the reed switch is exposed to a magnetic field, as is necessary for operation of the present invention. Alarm switch 16 can be configured to be normally closed or normally open. Preferably, alarm switch 16 is normally in a closed position. Closed position is used herein to mean that when the alarm switch is not affected by a magnet the switch is held closed, such that the alarm does not sound. Alarm switch 16 has a pair of lead wires 30 that extend therefrom to a conventional alarm 32 or other means for indicating that the switch has been turned on (described below), thereby electrically connecting alarm switch 16 to alarm 32. In a preferred embodiment, the wires 30 extend out of switch chamber 29. In an alternative embodiment the wires 30 can extend through an aperture defined in housing 14. In a preferred embodiment, the alarm 32 is configured such that if any of the wires 30 are cut alarm 32 is activated. Alarm 32 is conventional and can include, for example, an alarm control assembly and alarm bell or the like.

Housing 14 also has defined therein at least one, and preferably a pair of holes 34 for receiving a screw 24 or other fastener means. To affix switch assembly 12 to door frame 20 the screws 24 each are slipped through holes 22*a* in striker plate 22, holes 20*a* in door frame 20 and threaded into the holes 34. In an alternative embodiment, threaded fasteners can extend from switch assembly 12 and be engaged with door frame 20. Switch assembly 12 can also be secured to door frame 20 using an adhesive, clamps, other threaded fasteners or the like. It will be understood that the method of securing switch assembly 12 to door frame 20 is not a limitation on the present invention.

When switch assembly 12 is secured to door frame 20 an opening 22*b* in striker plate 22, an opening 20*b* in door frame 20 and opening 25 in housing 14 are substantially aligned, thereby defining a latch slot 42. Slidable door latch 10, which is secured to door 19, can be extended through latch slot 42.

Figure 7:
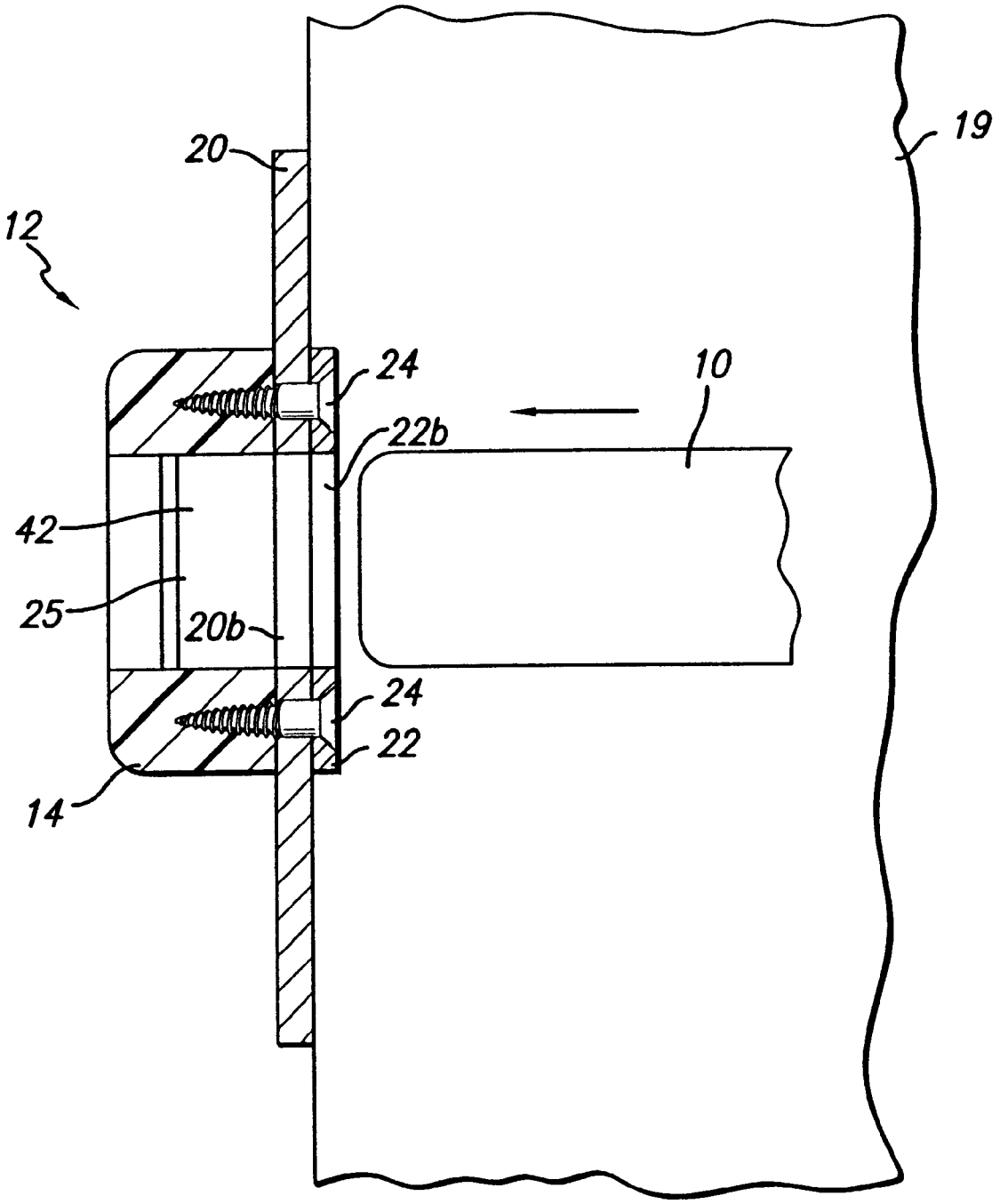
FIG. 7 is a sectional side elevation of a door assembly including the switch assembly of FIG. 3, showing the latch slot and the latch in the open position.

In operation, as mentioned above, alarm switch 16 is normally closed. When latch 10 is in its open position (not being fully inserted into latch slot 42 as shown in FIG. 7) the close proximity of magnet 18 to alarm switch 16 biases alarm switch 16 to the open position. When latch 10 is in its closed position, thus being fully inserted in latch slot 42 (including opening 25) the magnetic field produced by magnet 18 is blocked by the metal slidable door latch 10, thereby maintaining alarm switch 16 in the "closed" position. When latch 10 is withdrawn to its open position (the direction of which is shown by arrow A2 in FIG. 5), magnet 18 again biases alarm switch 16 to the open position thereby sending a signal through wire 30 and sounding alarm 32.

It will be understood that the sloped inner surfaces 26*a*, 26*c* provide for increased sensitivity of the assembly 12 as compared to a switch assembly without the sloped surfaces. The sloped surfaces 26*a*, 26*b* reduce the overall amount of material between magnet 18 and alarm switch 16 (as compared to a slot with straight parallel surfaces). Sloped surfaces 26*c* promote smooth latch 10 operation as latch 10 passes through housing 14 when being closed.

In an alternative embodiment, slot 25 is defined only part of the way through housing 14. In other words, slot 25 is closed such that it does not extend through the front surface 14*a* of housing 14. This completely prevents a "dummy" latch from being inserted into opening 25.

Switch assembly 12 can be sized to fit any size door latch. It will be appreciated by those skilled in the art that magnet 18 and alarm switch 16 can be configured for maximum sensitivity as desired.

It will be understood that the present invention is more difficult to defeat than the prior art. The increased sensitivity and the resistance to insertion of a "dummy" latch are advantages over the prior art. It is easy to fit a readily available size "dummy" latch into the space between the housing and latch in prior art alarm systems (see FIG. 2). Only a very thin "dummy" latch can be used to attempt to defeat the present invention. The increased sensitivity causes the alarm to be activated as the end of latch 10 is withdrawn from between surfaces 26*b*.

Figure 10:
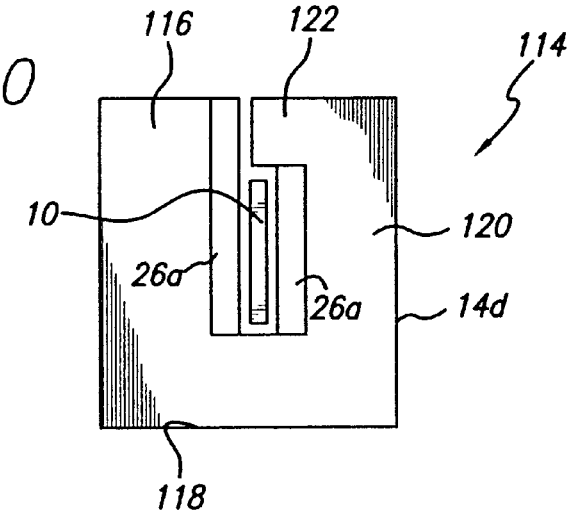
FIG. 10 is a front elevation of the housing in accordance with an alternative embodiment of the invention.

Referring to FIG. 10, in an alternative embodiment, housing 114 includes first 116, second 118 and third 120 portions. At least one blocking portion 122 extends inwardly from one or both of the first 116 and third 120 portions. Blocking portion 122 preferably extends inwardly across at least 25% of the width of slot 25, more preferably blocking portion 122 extends inwardly across at least 75% of the width of slot 25, and most preferably blocking portion 122 extends inwardly across 100% of the width of slot 25. The blocking portion 122 substantially prevents a "dummy" latch from being inserted from the top of housing 114, as is possible in the prior art (see FIG. 2). In order to insert a "dummy" latch from the top, the "dummy" latch would have to be flexible. The added time it would take a thief to bend the "dummy" latch to get it past the blocking portion 122 may prevent the crime from occurring. It will be understood that a blocking portion can be included on the bottom or sides also.

The embodiments of the present invention recited herein are intended to be merely exemplary and those skilled in the art will be able to make numerous modifications to them without departing from the spirit of the present invention. For example, the sloping surfaces 26*a* and 26*c* can be omitted and the magnet and switch chambers 28 and 29 can be completely enclosed in said housing (i.e., the switch and magnet can be molded in the housing). The slot does not have to be enclosed on all sides. All such modifications are intended to be within the scope of the present invention as defined by the claims appended hereto.

What is claimed is:

1. An alarm switch assembly comprising (a) a housing having front and back surfaces and having an opening defined therein that extends from said back surface toward said front surface, said opening being further defined by at least four inner surfaces, said housing including a blocking portion that defines at least one of said four inner surfaces, (b) a magnetic field generating device disposed adjacent a first one of said at least four inner surfaces and between said front and back surfaces, and a switch disposed adjacent a second one of said at least four inner surfaces that is opposite said first of said at least four inner surfaces, and (c) a latch disposed at least partially within said opening, whereby said blocking portion minimizes unauthorized tampering with said switch.

2. The assembly of claim 1 wherein said opening has a rectangular cross-section.

3. The assembly of claim 2 wherein said housing comprises a pair of projections, one each extending inwardly from said first and second inner surfaces.

4. The assembly of claim 1 wherein said opening comprises:

(a) a convergent section, and (b) a divergent section.

5. The assembly of claim 4 wherein said opening further comprises a throat section between said convergent section and said divergent section.

6. The assembly of claim 3 wherein said housing further defines a switch opening and a magnet opening in which said switch and said magnet are respectively disposed, and wherein said switch opening is at least partially defined in one projection and said magnet opening is at least partially defined in said other projection.

7. The assembly of claim 6 wherein said projections define an outer surface, wherein said switch opening substantially conforms to one of said outer surfaces, and wherein said magnet opening substantially conforms to said other of said outer surfaces.

8. The assembly of claim 1 wherein said switch includes a plurality of lead wires extending therefrom, said plurality of lead wires being adapted to electrically connect said switch to an alarm.

9. A latch system comprising:

(a) the alarm switch assembly of claim 8, and (b) said latch received in said opening, wherein a clearance is defined between said latch and at least one of said inner surfaces of said housing, said clearance not exceeding about 0.020".

10. An alarm system comprising (a) the latch system of claim 9, and (b) an alarm wherein said lead wires electrically connect said switch to said alarm.

11. A door assembly comprising:

(a) a door, (b) said latch slidably affixed to said door, (c) a door frame at least partially surrounding said door and having an opening defined therein, and (d) the alarm system of claim 10 affixed to said door frame, wherein said opening in said door frame and said opening in said housing cooperate to define a latch opening, wherein said latch is received in said latch opening, and wherein a clearance is defined between said latch and at least one of said inner surfaces of said housing, said clearance not exceeding about 0.020".

12. The alarm switch assembly of claim 11 wherein said blocking portion extends between said first and second inner surfaces.

* * * * *